US007157195B2

(12) United States Patent
Kokeguchi

(10) Patent No.: US 7,157,195 B2
(45) Date of Patent: Jan. 2, 2007

(54) RECORDING MATERIAL AND IMAGE FORMING METHOD

(75) Inventor: Noriyuki Kokeguchi, Kokubunji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 299 days.

(21) Appl. No.: 10/804,424

(22) Filed: Mar. 19, 2004

(65) Prior Publication Data

US 2004/0191653 A1 Sep. 30, 2004

(30) Foreign Application Priority Data

Mar. 28, 2003 (JP) ..... JP2003-090802

(51) Int. Cl.
*G03G 19/00* (2006.01)

(52) U.S. Cl. ..... 430/39

(58) Field of Classification Search ..... 430/39
See application file for complete search history.

(56) References Cited

U.S. PATENT DOCUMENTS 3,803,633 A * 4/1974 Duck ..... 346/74.3
5,223,360 A * 6/1993 Prengel et al. ..... 430/39
6,583,780 B1 * 6/2003 Kawai ..... 345/107

* cited by examiner

*Primary Examiner*—John L Goodrow
(74) *Attorney, Agent, or Firm*—Lucas & Mercanti, LLP

(57) ABSTRACT

An image forming method is disclosed, comprising (a) exposing a recording material comprising on a support an image forming layer containing colored magnetophoretic particles and a photopolymerizable composition to light to perform photocuring and (b) applying a magnetic field to the recording material to migrate the magnetophoretic particles.

12 Claims, 4 Drawing Sheets

RECORDING MATERIAL AND IMAGE FORMING METHOD

FIELD OF THE INVENTION

The present invention relates to a novel recording material which can be treated by the simplified dry-process and result in superior image lasting quality and an image forming method by the use thereof.

BACKGROUND OF THE INVENTION

Development of a technique for color printing which is simplified while producing no waste material is desired along with the recent explosive popularization of digital still cameras, internet infrastructure improvements and increased ecological concerns.

There are known a variety of color printing techniques. Silver halide color print systems produce waste material in the processing stage, increasing an environmental load. Ink-jet printing systems, sublimation type dye transfer systems and melt type dye transfer systems produce waste materials such as cartridges and ribbons in the color material supplying section.

Print systems not producing waste material include, for example, a system employing image formation by a thermal head and photo-fixing, as described in JP-A No. 6-127121 (hereinafter, the term JP-A refers to Japanese Patent Application Publication); a system using photosensitive microcapsules, a dye precursor and rupture of the microcapsules by applying pressure, as described in JP-A No. 2001-312058; a system using a color material and photosensitive microcapsules, as described in JP-A No. 2002-268237; and a system using a color developing agent precursor and a photosensitive microcapsule, as described in JP-A No. 2001-142204. There are also disclosed a display and a display material employing magnetic migration (which is hereinafter also denoted as magnetophoresis), including a colored pattern combination of particles and a dispersing medium, as described in JP-A No. 6-118882; a rewritable display material containing magnetophoretic particles, as described in JP-A No. 2002-148665; and a display material employing a dichromatic particulate material, as described in JP-A No. 2001-183707. However, none of the foregoing patent documents discloses a print recording technique relating to the present invention in which magnetically mobile colored particles (hereinafter, also denoted as magnetophoretic particles) and a photopolymerizable composition are used in combination, and photo-curing and magnetic migration (or magnetophoresis) are combined.

SUMMARY OF THE INVENTION

It is an object of the present invention to provide an image forming method by the use of a recording material having a noble composition and a simplified processing method, leading to color prints exhibiting superior image lasting quality.

One aspect of the invention is directed to an image forming method comprising (a) exposing a recording material comprising on a support colored magnetophoretic particles and a photopolymerizable composition to light to perform photocuring and (b) applying a magnetic field to the recording material to migrate the magnetophoretic particles.

Another aspect of the invention is directed to a recording material comprising on a support colored magnetophoretic particles and a photopolymerizable composition.

DETAILED DESCRIPTION OF THE INVENTION

Figure 1:
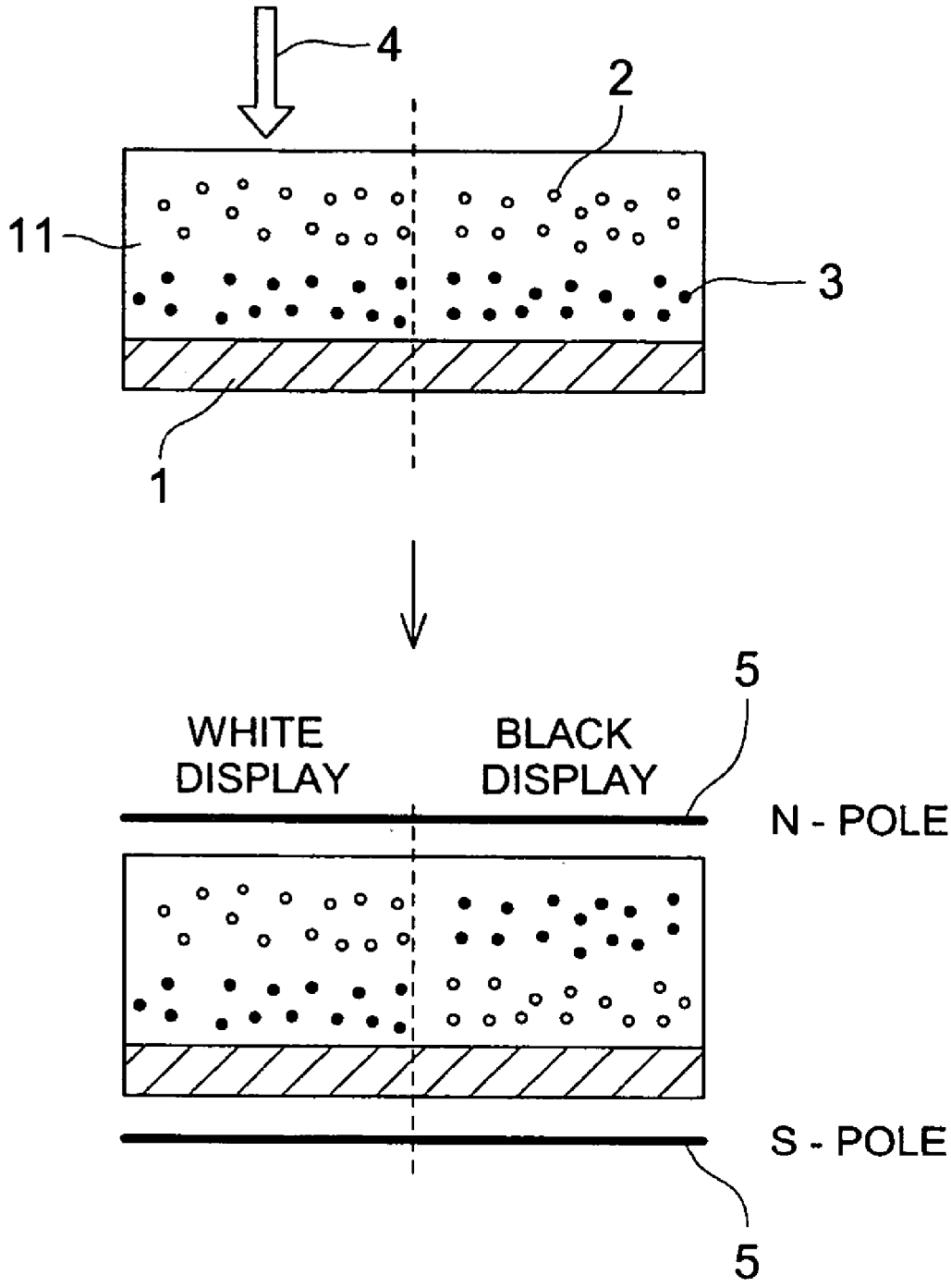
FIGS. 1 to 3 each illustrates a recording material and an image forming method relating to embodiments of the invention.

The recording material relating to this invention comprises on a support colored magnetophoretic particles and a photopolymerizable composition. Magnetic migration (or magnetophoresis), which is one of magneto-kinetic effects, is the migration of small particles in a magnetic field toward a magnetic pole. In this invention, the magnetophoretic particles refer to particles capable of migrating through a medium under the action of a magnetic field applied to the magnetic poles. Thus, the magnetophoretic particles can move in one direction toward one of two magnetic poles when a magnetic field is applied thereto. In one preferred embodiment of this invention, colored magnetophoretic particles are white particles and black particles. To observe as a color image, yellow (Y), magenta (M) and cyan (C) filters, or blue (B), green (G) and red (R) filters may be used, or white, black, Y, M, C, B, G, R or other colored particles which are incapable of migrating in a magnetic field, may be used.

In another embodiment of this invention, the recording material comprises colored magnetophoretic particles and a photopolymerizable composition on a support, in which the colored magnetophoretic particles are comprised of yellow particles, magenta particles and cyan particles.

The colored magnetophoretic particles usable in this invention include any organic or inorganic particles exhibiting magnetophoretic mobility, which may not be necessarily a single chemical composition and may be a mixture thereof. Coloring may be anyone of white, black, yellow, magenta and cyan. A mixture may be harmonized with different chemical species, such as chemical species manifesting magnetic migration property, chemical species shielding a background color and chemical species giving coloring property.

The colored magnetophoretic particles may contain magnetic oxide materials such as black magnetite, chromium dioxide, spinel ferrite, magnetoplumbite, black iron oxide, porous iron oxide and iron oxide containing manganese dioxide, or magnetic metal materials selected from cobalt, iron, copper, nickel, chromium, stainless steel and their alloys. Examples of commercially available materials include magnetite TODA COLOR KN-320 (product by Toda Kogyo Co., Ltd.), TALOX BL-50 (product by Titan Kogyo Co., Ltd.), stainless steel DAP410L (product by Daido Tokushu Kogyo Co., Ltd.), silicon steel, and stainless steel SUS343, SUS343L, SUS405, SUS410L, SUS430, SUS434 and SUS329JI.

Methods for coloring magnetophoretic particles include, for example, the use of colored magnetic particles, and coloring magnetic particles or a resin included in magnetophoretic particles by employing a spray dry method, a rolling fluidized granulation coating method or a dichroic particulate preparation method, as described in JP-A No. 2002-273193.

Examples of colored magnetic particles include yellow particles (e.g., cobalt oxide, titanium oxide, nickel oxide), green particles (e.g., cobalt oxide, titanium oxide, cobalt oxide, nickel oxide, zinc oxide), blue pigments (e.g., cobalt oxide, aluminum oxide) and red pigments (e.g., iron oxide).

Colored magnetophoretic particles usable in this invention may contain composite particles comprising a pigment and a polymeric resin, as described in JP-A Nos. 2002-311646, 2003-15352, 2002-236386, 2002-214913, 2001-281928 and 2001-249497.

The colored magnetophoretic particles may contain, as a coloring medium, synthetic resins such as a polystyrene, a acryl resin and a polyester. For example, the particles are coated with the foregoing coloring medium by a method such as a spray-drying method and further thereon coated with a coloring component, or the resin may be dyed with dyes. Such resin-coated particles can be used as white particles by providing a light scattering property to the particles. Polymeric resins used to mordant a coloring component include, for example, compounds described in U.S. Pat. No. 4,500,626 (col. 58–59), JP-A Nos. 61-88256 (page 32–41), 62-144043 and 62-244036.

As a dye coloring component are usable commonly known dyes. Specific examples thereof include dyes described in European Patent No. 549,489; dyes ExF2 to 6 described in JP-A No. 7-152129; dyes AI-1 to -11 described in JP-A No. 3-251840, page 308; dyes described in JP-A No. 6-251840; dyes described in JP-A No. 6-3770; compounds represented by general formulas (I), (II) and (III) described in JP-A No. 1-280750, page 2, left column; compounds (1) to (45) described in ibid, page 3, left lower column to page 5, left lower column; compounds described in JP-A No. 1-150132; compounds described in Moriga, Yoshida, "Senryo to Yakuhin" (Dye and Chemicals), No. 9, page 84 (Kaseihin Kogyo Kyokai); "Shinban Senryo Binran" Dye Handbook) page 242 (Maruzen, 1970); R. Garner "Reports on the Progress of Appl. Chem." 56, page 199 (1971); "Senryo to Yakuhin", No. 19, page 230 (Kaseihin Kogyo Kyokai 1974); "Shikizai" (Colorant Material) No. 62, page 288 (1989), "Senryo Kogyo" (Dyestuff Industry) No. 32, page 208; and compounds in Research Disclosure (hereinafter, also denoted simply as RD) vol. 176, Item 17643 (December, 1978), page 25–26; RD vol. 184, Item 18431 (August, 1979), page 648–650; and RD vol. 308, Item 308119 (December, 1989), page 1003. The foregoing dyes may be used in a dispersing medium of the magnetophoretic particles.

Examples of preferred dyes used for yellow particles include Color Index (hereinafter, denoted simply as C.I.) Direct Yellow, C.I. Acid Yellow 23, C.I. Acid Yellow 79, C.I. Pigment Yellow 128 and compounds designated as C.I. Nos. Y-3, Y-167, Y-97, Y-74, Y-12, Y-14, Y-17, T-55, Y-83, Y-154, Y-95, Y-193, Y-83, Y-34, Y-128, Y-93, Y-110, Y-139, Y-199, Y-147, Y-109, Y-13, Y-151, and Y-154. Examples of preferred dyes used for magenta particles include Acid 52, C.I. Projet Mazenta, C.I. Pigment Red 122, and compounds designated as C.I. Nos. R-48:1, R-53:1, R-49:1, R-48:3, R-48:2, R-57:1, R-63:1, R-58:4, O-16, R-112, R-3, R-170, R-5, R-146, R-81, V-19, R-122, R-257, R-254, R-202, R-211, R-213, R-268, R-177, R-17, R-23 and R-31. Examples of preferred dyes used for cyan particles include C.I. Acid Blue 9, C.I. Direct Blue 199, C.I. Pigment Blue 15:3, and compounds designated as C.I. Nos. B-15, B-15:1 to 15:4, and B-27.

Preferred examples of colored magnetophoretic particles used in this invention include those obtained by coating the magnetic metal material described earlier with a resin and dyeing the coated resin white, black, yellow, magenta or cyan; and those obtained by having a coloring component mixed with or melted into the magnetic metal material.

The photopolymerizable composition of this invention is a general term, including a photopolymerizable compound, photopolymerization initiator, spectral sensitizer, plasticizer, surfactant and photosensitivity enhancing agent. The photopolymerization composition preferably comprises at least a photopolymerizable compound, a photopolymerization initiator and a spectral sensitizer. As a photopolymerizable compound are usable compounds containing one or plural vinyl groups. Examples of such a vinyl group-containing compound include acrylic acids, acrylic acid esters, acrylic acid amides, methacrylic acids, methacrylic acid esters, methacrylic acid amides, anhydrous maleic acid, maleic acid esters, itaconic acids, itaconic acid esters, styrenes, vinyl ethers, vinyl esters, N-vinyl heterocyclic compounds, aryl ethers, vinyl esters, allyl esters, and compounds containing an acryloyl group, methacryloyl group, allyl group, unsaturated polyester group, vinyloxy group or acrylamido group.

As the photopolymerization initiator is usable any compound capable of providing, upon exposure to light, a trigger which allows a photopolymerizable compound to polymerize. Such a trigger includes radical-generating compounds and compounds generating an ionic compound such as cation or anion. Examples of radical generation include generating a free radical through Norrish type I cleavage as in benzoin alkyl ether (halides, phosphineoxide compounds, organic sulfur compounds, oxime esters, peroxides, etc.), a system of efficiently generating a free radical upon interaction with other molecule, radical generating systems described in Monroe, Chemical Review [93], 435–446 (1995); S. P. Pappas, J. Rad. Curing, 14 [3], 6 (1987); G. L. Bassi, J. Rad. Curing, 14 [3], 18 (1987); E. Kustormann, Wiss. Zeitschr. THLM, 29 [3], 287 (1987); K. Tokumaru, "Zokanzai", Kodan-sha Scientific, page 64 (1987); A. Umehara "Kobunshi-gakkai 87/3 Insatsu-Johokiroku Kenkyukai", page 5 (1987); and "Photopolymer Technology" Nikkankogyo Shinbunsha (1988), and a dye sensitizing system. Specific examples of such a radical generating compound include aromatic carbonyl compounds, acetophenones, organic peroxides, dienylhalonium salts, organic halogen compounds, 2,4,6-substituted S-triazines, 2,4,5-triaryl imidazole dimmer, azo compounds, metal arene complexes, titanocene compounds, organic borate complex or its dye salt, and compounds described in JP-A Nos. 62-150242, 64-60606, 3-20260 and 3-116043.

The spectral sensitizer used in this invention is a compound which is capable of transferring, upon light absorption, an electron or energy to the foregoing photopolymerization initiator or photopolymerizable compound, and, for example, commonly known spectral sensitizing dyes are usable in this invention. Examples of a preferred sensitizing dye include cyanine dyes, merocyanine dyes, complex cyanine dyes, oxanol dyes, squalium dyes, triarylmethane dyes, pyrylium dyes, holopolar cyanine dyes, hemicyanine dyes, styryl dyes and hemioxonol dyes. Specific examples there of are compounds described in U.S. Pat. No. 4,617,257; JP-A Nos. 59-180550, 64-13546, 5-45828, 5-45834; U.S. Pat. No. 3,615,641; JP-A Nos. 63-23145; U.S. Pat. Nos. 4,183,756 and 4,225,666; RD 176 Item 17643 (December, 1978), RD 184 Item 18431 (August, 1979), RD 187 Item 18716 (November 1979), and RD 308 Item 308119 (December 1989). In this invention, a spectral sensitizer of which visible absorption is decolorized by self absorption or the photopolymerizable composition such as a radical generating agent is preferable.

The photopolymerizable composition may be a multifunctional compound having plural functions chosen from the foregoing photopolymerizable compound, photopolymerization initiator and spectral sensitizer.

In one preferred embodiment of this invention, the recording material comprises on a support microcapsules including colored magnetophoretic colored particles and a photopolymerizable composition. Microcapsules can be prepared using commonly known techniques. Specific examples thereof are described in U.S. Pat. Nos. 2,800,457, 2,800,458, 3,111,407, 3,281,282, 3,287,154, 3,418,250, 3,660,304, 3,773,695, 3,793,68, 3,796,669, 3,914,511, 4,001,140, 4,087,376, 4,089,802, 4,025,455; JP-B Nos. 38-19574, 42-446, 42-771, 36-9168, 48-40347, 49-24159, 48-80191, 48-84086 and 51-9079 (hereinafter, the term JP-B refers to Japanese Patent Publication); JP-A No. 51-9079; British Patent Nos. 952,807, 965,074, 990,443 and 930,422; and T. Kondo "Microcapsule" Nippon Kikaku Kyokai (1991). Methods for preparing microcapsules include a phase separation from an aqueous solution, coacervation, interfacial polymerization, monomer in situ polymerization, melt dispersion cooling method and a spray drying method. Examples of microcapsule wall material include polyurethane, polyurea, polyamide, polyester, polycarbonate, isocyanate polyol, isocyanate, urea-formaldehyde resin, urea-formaldehyde-resorcinol resin, melamine-formaldehyde resin, and hydroxypropyl cellulose resin. Microcapsules preferably have an average particle size of 0.01 to 50 μm. In this invention, microcapsules can include colored magnetophoretic particles, a photopolymerizable compound, a spectral sensitizer and a photopolymerization initiator. White or black non-magnetic particles may be contained in an magnetophoretic dispersing medium included in microcapsules.

In one preferred embodiment of this invention, the recording material comprises colored magnetophoretic particles and a photopolymerizable composition on a support which was previously recessed at regular intervals, i.e., a support having recesses at regular intervals. Synthetic plastic films are preferably used as a support of this invention, including polyolefines such polyethylene and polypropylene, polycarbonates, cellulose acetate, polyethylene terephthalate, polyethylene dinaphthalene dicarboxylate, polyethylene naphthalate, polyvinyl chloride, polyimide, polyvinyl acetals and syndiotactic polystyrenes. These can be obtained by methods described in JP-A Nos. 62-117708, 1-46912 and 1-178505. There are also usable paper supports such as photographic base paper, printing paper, baryta paper and resin-coated paper, a support provided with a reflection layer on the foregoing plastic film and supports described in JP-A No. 62-253195 (page 29–31). Furthermore, supports described in RD No. 17643 (page 28), RD No. 18716 (page 647, right column to page 648, left column) and RD No. 307105 (page 879) are also preferably used. The foregoing supports may be subjected to a thermal treatment at a temperature lower than Tg to reduce roll set curl, as described in U.S. Pat. No. 4,141,735. The support surface may be subjected to a surface treatment to enhance adhesion of the support onto a component layer. There are applicable surface treatments such as a glow discharge treatment, UV irradiation treatment, corona discharge treatment and flame treatment. Furthermore, supports described in "Kochi Gijutsu" No. 5 (Mar. 22, 1991, Aztec Co.), page 44–149 are usable. There are also usable supports described in RD No. 308119, page 1009 and Product Licensing Index vol. 92, page 108, item "Support".

Recessing a support can be conducted by commonly known processing, such as laser processing, calendaring, and rib-paste printing by using a screen plate. Recesses (or hollows) may be arranged in a stripe form or in a honeycomb form. Plural recesses are arranged at regular intervals and the interval preferably is 1 to 300 μm. The depth of the recess is preferably 0.3 to 0.7 times the thickness of the support. In the laser processing, the output of an excimer laser is controlled to control the recess depth. In the calendaring process, the roll, whose surface has been thermally sprayed with ceramic and engraved by a laser, is heated to a temperature higher than the glass transition temperature of the support and pressed onto the support. In rib-paste printing by using a screen plate, a rib-paste is coated on a support using a screen with a pitch of 1 to 300 μm to control the depth. At least colored magnetophoretic particles and a photopolymerizable composition are allowed to be included in the respective hollow portions of the support.

In one preferred embodiment of this invention, the recording material comprises colored magnetophoretic particles, a photopolymerizable composition and spacer particles. The spacer particles may be in a spherical form or a cylindrical form. Spherical spacer particles preferably have an average particle diameter of 0.01 to 50 μm The spacer particles may be comprised of photosensitive resin or non-photosensitive resin. A mixture of novolak resin and naphthoquinonediazido-disulfonic acid ester is usable as a positive-working photosensitive resin. Negative-working photosensitive resins usable in this invention include, for example, a cyclized rubber-bisazido type, a phenol resin-azido type and a chemical sensitization type. Epoxy resin, acryl resin, urethane resin, polyester resin, polyimide resin and polyolefin resin are also usable in this invention. Silica, barium sulfate, barium carbonate, calcium carbonate, talc, zilconia, magnesia, beryllia, mullite, cordierite, glass-ceramic powder barite may be incorporated into the spacer particles to enhance mechanical characteristics of the particles.

In one preferred embodiment of this invention, the recording material comprises, on a support, colored magnetophoretic particles and a photopolymerizable composition, and further comprising a white light-scattering layer. The white light-scattering layer is referred to as a component layer exhibiting a color tone having an absolute value of a* of 10 or less, an absolute value of b* of 10 or less and an absolute value of L* of 70 or more in terms of the Lab chromaticity system. The white light-scattering layer is comprised of white particles and a binder. Alternatively, the white light-scattering layer is comprised of a binder containing light-scattering voids differing in refractive index from the binder. Binders described in JP-A No. 64-13546, page 71–75 are usable in this invention. Binders usable in this invention are transparent or semi-transparent, and are generally colorless, including natural polymers and synthetic polymer resins. Specific examples thereof include gelatin arabic gum, poly(vinyl alcohol), hydroxyethyl cellulose, cellulose acetate, cellulose acetate butyrate, poly (vinyl pyrrolidone), casein, starch, poly(acrylic acid), poly (methyl methacrylate), poly(vinyl chloride), poly (methacrylic acid), copoly(styrene-maleic acid), copoly (styrene-acrylonitrile), copoly(styrene-butadiene), poly (vinyl acetal) such as poly(vinyl formal)and poly(vinyl butyral), polyester, polyurethane, phenoxy resin, poly(vinylidene chloride), polyepoxide, polycarbonate, poly(vinyl acetate), cellulose ester, polyamide, poly(vinyl acetate), cellulose ester and polyamide. Hydrophobic transparent binders include poly(vinyl butyral), cellulose acetate, cellulose acetate butyrate, polyester, polycarbonate, poly(acrylic acid) and polyurethane.

In one preferred embodiment of this invention, the recording material comprises colored magnetophoretic particles and a photopolymerizable composition, and further comprising an organic solvent exhibiting a relative dielectric constant of 2.5 to 10.0 at 20° C. The relative dielectric constant is referred to as a dielectric constant relative to that of vacuum at 20° C., which can be determined by using a commercially available measurement apparatus for dielectric constants, for example, HP E5050A HEWLET PACKRD. Dielectric constant values are described in "Kagaku Binran" (Handbook of Chemistry, 4th edition, Maruzen Co., Ltd.) and "Yozai (Solvent) Handbook" (1st edition, Kodansha Scientific). In cases where an objective material to be measured for dielectric constant is not liquid at 20° C., the objective material is thermally melted, followed by formation of supercooled liquid to be measured. Alternatively, the objective material is mixed with a liquid having a known relative dielectric constant and the relative dielectric constant of the mixture is determined to extrapolate the relationship between weight fraction and relative dielectric constant. Specific example of such a solvent include ethylbenzene, dibutylbenzene, dibutyl ether, dipropylamine, pentylamine, ethylhexylamine, cyclohexylamine, chloroform, propyl propionate, butyl propionate, butylamine, butyl acetate, bromobenzene, ethylene glycol dimethyl ether, methyl acetate, ethyl propionate, chlorobenzene, piperidine, ethyl acetate, propyl acetate, chloropentane, methyl acetate, butyl bromide, dicyclohexylamine, aniline, tetrahydrofuran, butyl chloride, morpholine, propyl chloride, methylene chloride, diethyl malonate, propyl bromide, dichloroethane, chlorinated paraffin, dibutyl phthalate, dioctyl phthalate, tri-2-ethylhexyl-phosphate, tricresyl phosphate, and compounds S-1 through S-18 described in JP-A No. 2001-117205.

In one preferred embodiment of this invention, the recording material comprises colored magnetophoretic particles and a photopolymerizable composition, and further comprising a protective layer containing a polyvinyl alcohol. The polyvinyl alcohol may be any compound having a partial structure (or repeating unit) of —[$CH_2CH(OH)$]— and also including modified polyvinyl alcohols such as terminal alkyl-modified polyvinyl alcohol, terminal mercapto group-modified polyvinyl alcohol, acetylated polyvinyl alcohol, butyralated polyvinyl alcohol and carboxylated polyvinyl alcohol. A polyvinyl alcohol preferably has a saponification degree of 80% to 99.9% and a polymerization degree of 300 to 3500. Commercially available compounds are found in "PVA Seihin Sogo Catalog" (Shin-Etsu Chemical Co., Ltd) and "Kuraray Poval" (KURARAY CO., LTD.). Examples of specific compounds include A, C-17GP, C-20, C-25GP, MA05GP, MA-17GP, MA-23GP, PA-05GP, PA-10GP, PA-L5GP, PA-18GP, PA-20GP, AND GA-24GP, which are available from Shin-Etsu Chemical Co., Ltd.; PVA-105, PVA-117, PVA-120, PVA-124, PVA-126H, PVA-135H, PVA-617, PVA-624, PVA-706 MP-102, MP-202, MP-103, MP-203, which are available from KURARAY CO., LTD. Polyvinyl alcohols are detailed in H. Nagano, S. Yamane & K. Toyoshima "Poval" (Kobunshi-Kankokai), and C. A. Finch, Polyvinyl Alcohol-Developments (John Wiley & Sons Co. Ltd., 1992) page 77–156. The protective layer containing polyvinyl alcohol may further contain a polymer forming the foregoing binder. Incorporation can be conducted in accordance with methods described in European Patent No. 698,816 and U.S. Pat. Nos. 5,567,473 and 5,695,862.

In one preferred embodiment of this invention, the recording material comprises colored magnetophoretic particles and a photopolymerizable composition, and the overall water content of constituent layer(s) on the side of the magnetophoretic particles is 0.01% to 10%. The water content is defined as follows. That is, after the recording material is allowed to stand at 40° C. and 60% RH for 48 hr., the weight of the recording material per unit area is designated as weight (1); the weight of the recording material per unit area immediately after being allowed to stand in vacuo is designated as weight (2); and the water content is defined according to the following equation:

$$\text{water content (\%)}=[\text{weight}(1)-\text{weight}(2)]/\text{weight}(2)\times 100$$

The water content can be adjusted to an objective value by selecting a binder of the recording material, controlling drying conditions in the process of preparing the recording material and selecting sealing material for the recording material.

In one preferred embodiment of this invention, the recording material comprises colored magnetophoretic particles and a photopolymerizable composition, and the surface of the magnetophoretic particle side of the recording material exhibits a surface roughness (Ra) of 0.01 to 2.0 μm. The surface roughness (Ra) refers to a center-line mean roughness, as defined in JIS B0601 or ISO 468-1982. An Ra of less than 0.01 μm results in deteriorated transportability, while being overlapped, due to surface smoothness, and a Ra of more than 2.0 results in a non-uniform magnetic field strength caused by the uneven surface, leading to unstable electrophoresis characteristics.

In one preferred embodiment of the image forming method, a magnetic field is applied to a recording material which comprises colored magnetophoretic particles and a thermosetting resin on a support to migrate the colored magnetophoretic particles to and then, the recording material is heated at a temperature of 60 to 220° C. to perform heat curing. Application of the magnetic field is conducted similarly to the manner described above and heat-curing the magnetophoretic medium comprising the thermosetting resin can secure the magnetophoretic particles, leading to enhanced weather resistance of formed images. Thermosetting resins usable in this invention include polyisocynate resin, epoxy resin, acryl resin, silicone resin, polyurethane resin, urea resin, phenol resin, formaldehyde resin, epoxy-polyamide resin, melamine resin and alkyd resin. Specific examples thereof include Takenate D-102, Takenate D-110N, Takenate D-200, Takenate D-202 (which are available from Takeda Chemical Industries, Ltd.); Desmodule L, Desmodule IL, Desmodule N, Desmodule HL (which are available from Sumitomo Bayer Co.); Coronate L, Coranate HL, Coronate 2030, Coronate 2031, Millionate MR, Millionate MTL (which are available from Nippon Polyurethane Co.). The thermosetting resin preferably has a glass transition temperature of 60° C. to 150° C. A glass transition temperature lower than 60° C. results in insufficient fixation of the magnetophoretic particles, leading to deteriorated weather resistance. A glass transition temperature higher than 220° C. results in unacceptable conditions such as deteriorated surface gloss of the recording material.

In the recording material according to this invention, there are usable a chemical sensitizer, a spectral sensitizer, a supersensitizer, an antifoggant and a stabilizer, an antistaining agent, a color image stabilizer, a brightening agent, a UV absorber, a light scattering agent, a filter dye, a binder, an antistatic agent, a hardener, a plasticizer, a lubricant, a surfactant, a coating aid, a matting agent and a developer, as described in RD 308119, as described in RD 17643, RD 18716 and RD 308119.

The image forming method according to this invention comprises (a) exposing a recording material comprising on a support colored magnetophoretic particles and a photopolymerizable composition to light to perform photocuring and (b) applying a magnetic field to the recording material to migrate the magnetophoretic particles. In one embodiment of the image forming method, the recording material is imagewise exposed to light to perform photocuring (or photopolymerization) and then, a magnetic field is applied to the recording material to cause the colored magnetophoretic particles to migrate in the magnetic field. Thus, the method comprises (i) imagewise exposing the recording material to cause photopolymerization (or photocuring) in exposed areas and then, (ii) allowing the exposed recording material to be placed in a magnetic field to migrate the magnetophoretic particles in unexposed areas. In general, the magnetophoretic migration rate or magnetophoretic mobility is proportional to the dielectric constant of the electrophoresis medium and the zeta potential of the magnetophoretic particles, and is inversely proportional to the viscosity of the electrophoresis medium. In the foregoing image forming method, every picture element (pixel) is exposed to light at an intensity and a wavelength corresponding to the output image to cause the electrophoresis medium to be photocured to differentiate the magnetophoretic migration rate or magnetophoretic mobility and then, a magnetic field is applied thereto to cause the magnetophoretic particles to migrate to form an image.

A laser light source is preferably employed as a light source for light exposure. Examples of the laser light source include gas lasers (e.g., Ar laser, He-Ne laser, carbon-dioxide laser, excimer laser), solid lasers (e.g., ruby laser, Pr-YLF laser, Nd-YAG laser, Nd-glass laser, Q switch laser), semiconductor laser (e.g., end face emitting type semiconductor laser, face emitting type semiconductor laser) and dye lasers. A SHG (second harmonic generation) element may be used in combination with a solid laser to obtain a specific wavelength. A semiconductor laser is advantageously used in terms of apparatus compactness. Semiconductor lasers having central oscillation wavelengths of 680 nm, 532 nm and 410 nm can be used as red, green and blue, respectively, to separate color sensitivity based on wavelength. The light irradiation energy preferably is 0.01 to 50 mJ/cm$^2$ in terms of storage stability of the recording material and compactness of the apparatus.

In this invention, application of a magnetic field can be performed using various kinds of commonly known magnets. For example, a single polar magnet may be arranged on one side of the recording material or opposite polar magnets are arranged on both sides of the recording material. There may be used an auxiliary magnet used for erasing.

In one embodiment of the image forming method of the invention, a magnetic field is applied to the recording material which comprises colored magnetophoretic particles and a photopolymerizable composition on a support, to allow the colored magnetophoretic particles to migrate and then, the recording material is exposed to light to perform photocuring. Application of a magnetic field may be performed by controlling the intensity of the magnetic field applied to the respective picture elements and the applying time. Alternatively, a uniform magnetic field may be applied to the total picture elements. For example, a magnetic field is imagewise applied to the recording material to cause the colored magnetophoretic particles to migrate in the magnetic field and then the recording material is overall exposed to light to cause photocuring. Photocuring the magnetophoretic medium after application of a magnetic field can secure magnetophoretic particles, thereby leading to enhanced weather resistance of formed images. Application of a magnetic field to every picture element reduces the light irradiation stage, resulting in a compact apparatus.

In one embodiment of the image forming method of the invention, the recording material comprising colored magnetophoretic particles and a photopolymerizable composition on a support is exposed to light to perform photocuring of the photopolymerizable composition, followed by application of a magnetic field to migrate the magnetophoretic particles and then the recording material exposed to light to perform photocuring to secure the magnetophoretic particles. Photocuring before and after application of a magnetic field to migrate the magnetophoretic particles leads to formation of images exhibiting superior sharpness and light exposure using the same light source leads to miniaturization of the apparatus.

The recording material is exposed preferably to light having plural peak wavelengths in the range of 400 to 700 nm to perform photocuring. Photocuring is performed preferably using a blue light of 400 to 500 nm, a green light of 500 to 600 nm and a red light of 600 to 700 nm.

EXAMPLES

The present invention will be further described based on examples but the embodiments of this invention are by no means limited to these.

Example 1

A paper support laminated with a high density polyethylene on both sides of base paper of 180 g/m$^2$ was prepared, in which a polyethylene melt containing 15% by weight of surface-treated anatase type titanium oxide was laminated on the image forming side to obtain a reflection support. A solution comprising a mixture of 25 parts of pentaerythritol tetraacrylate, 75 parts of pentaerythritol hexaacrylate, 0.2 part of pentaerythritol tetrakis-3-mercaptopropionate and 0.7 part of Irgacure 261 (available from Ciba Speciality Chemicals Co.) was dispersed in an amount of 10 parts, in an oil droplet form, in a 10% aqueous solution of polyvinyl alcohol (PVA 117, Kuraray Co.) containing 3 parts of nonionic surfactant BO-10X (available from Nikko Chemicals Co.) and having white magnetophoretic particles which was obtained by coating black magnetite with acryl resin and non-magnetic black particles of carbon black dispersed therein. The thus obtained mixture solution was coated on the foregoing reflection support and dried, and further thereon, a protective layer of Cybinol EK-55 (acryl resin, available from Cyden Chemicals Co.) was coated in an amount of 5 g/m$^2$ and dried to prepare recording material, as shown in FIG. 1. In FIG. 1, the numerals 1, 2, 3 and 11 designate the foregoing support, white magnetophoretic white particles, black non-magnetic particles and photopolymerizable composition, respectively.

As shown in FIG. 1, after the recording material was subjected to pattern exposure (i.e., imagewise light exposure) at 1000 lux for 30 sec., a magnetic field of a 100 mT flux density was applied thereto from both sides of the recording material. As a result, a tone pattern comprised of white (minimum reflection density) and black (maximum reflection density) was obtained in accordance with the exposure pattern. In FIG. 1, the numerals 4 and 5 designate light exposure (or photo-cured areas) and a magnet, respectively. After image formation, Sample 1 was allowed to stand in a conditioning oven at 80° C. and 60% RH to undergo accelerated aging and evaluated with respect to variation in reflection density between before and after aging, based on the following equation:

variation in reflection density (%)=[(maximum reflection density after aging minus minimum reflection density after aging)/(maximum reflection density before aging minus minimum reflection density before aging)]×100.

It was proved that the recording material exhibited a reflection density variation of 87% and superior storage stability was achieved.

Example 2

A magnetic field of a 100 mT flux density was imagewise applied to the recording material of Example 1 from both sides thereof and the recording material was overall exposed to light at 1000 lux for 60 sec. As a result of evaluation similar to Example 1, it was proved that the recording material exhibited a reflection density variation of 90% and superior storage stability was achieved.

Example 3

Figure 2:
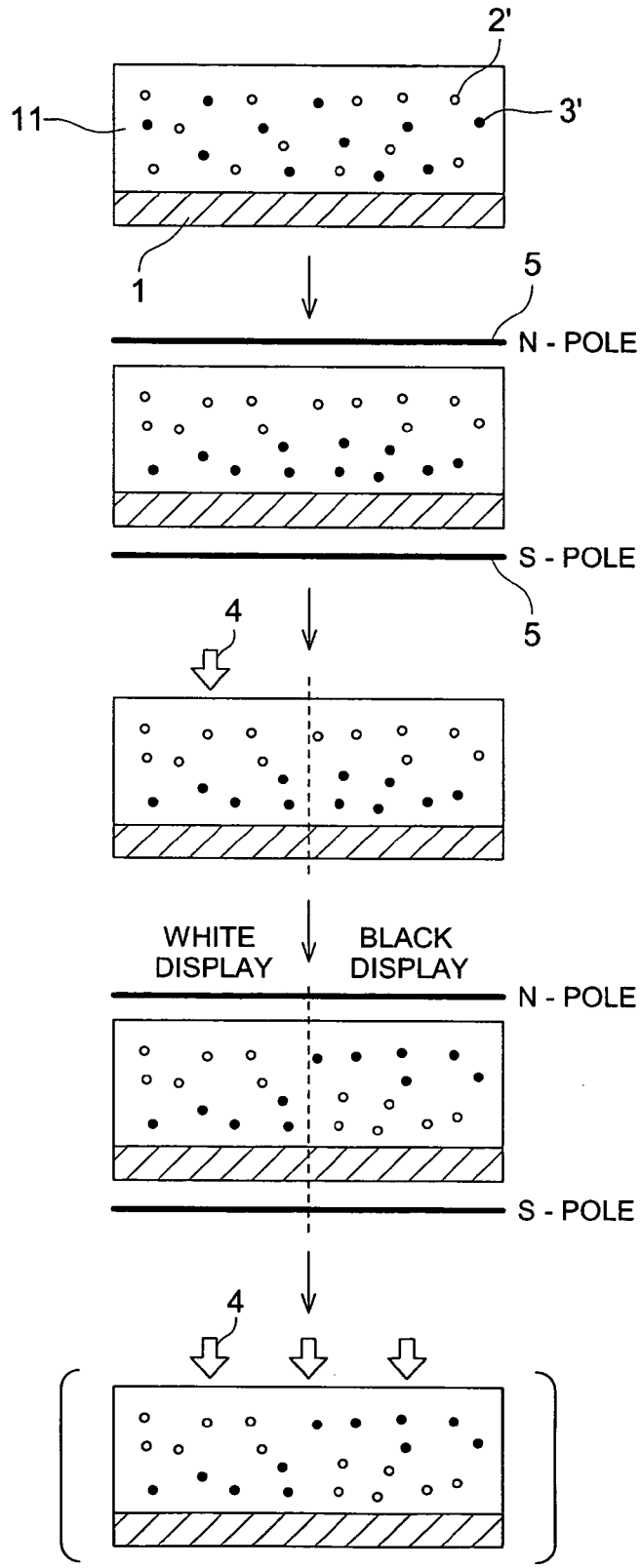

As shown in FIG. 2, a recording material was prepared similarly to Example 1, except that white magnetophoretic particles (2) and black non-magnetic particles (3) were replaced by white non-magnetic particles (2') and black magnetophoretic particles (3'), respectively. As shown in FIG. 2, a magnetic field of a 100 mT flux density was applied to the recording material from both sides thereof to match colors (or to arrange for colors of colored particles to be uniform). Further, after being subjected to pattern exposure at 1000 lux for 30 sec., a reversed magnetic field of a 100 mT flux density was applied to the recording material from both sides thereof. Finally, the material is exposed to fix the overall image. As a result, a tone pattern comprised of white (minimum reflection density) and black (maximum reflection density) was obtained in accordance with the exposure pattern. Thus, obtained recording material was evaluated similarly to Example 1 and it was proved that the recording material exhibited a reflection density variation of 93% and superior storage stability was achieved.

Example 4

Figure 3:
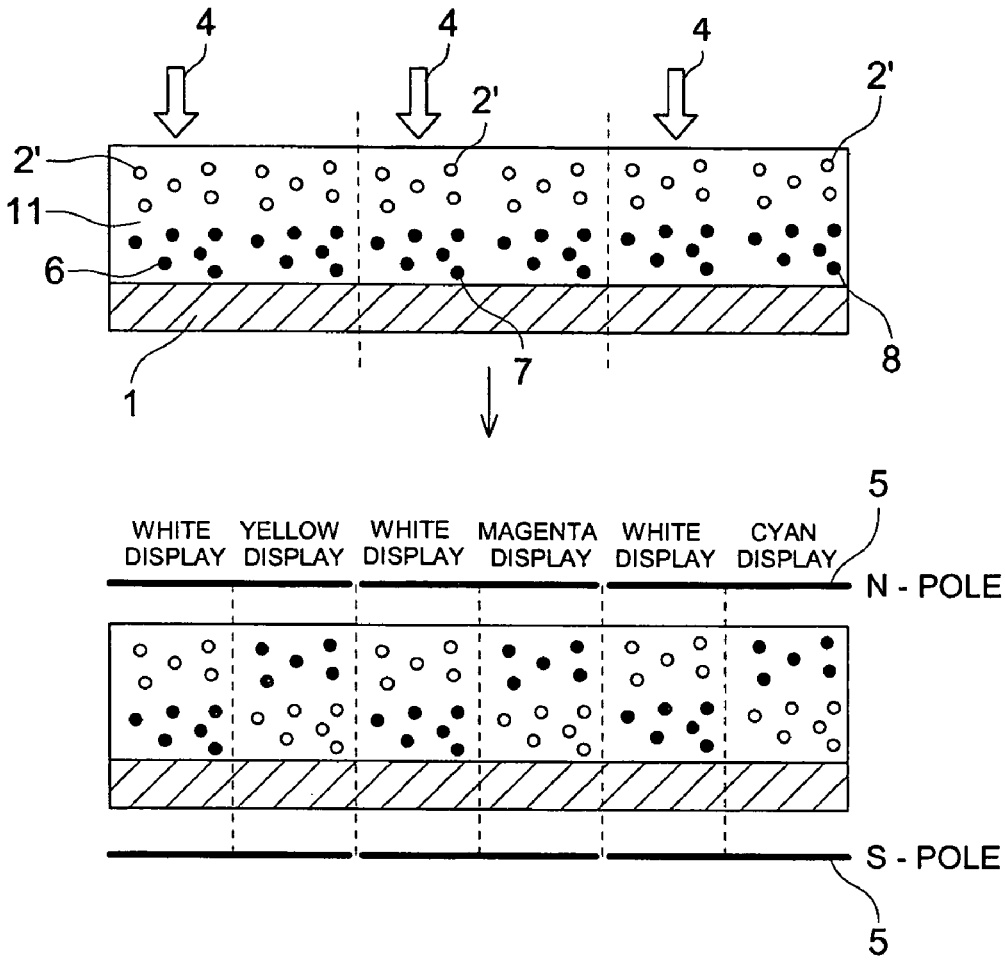

Yellow magnetophoretic particles (6), magenta magnetophoretic particles (7) and cyan magnetophoretic particles (8) were each prepared by coating C.I. Pigment Yellow 138, C.I. Pigment Red 184 and C.I. Pigment Blue 68, respectively. A recording material was prepared similarly to the recording material of Example 1, provided that black non-magnetic particles (3) of carbon black used in Sample 1 were replaced by each of the foregoing yellow magnetophoretic particles (6), magenta magnetophoretic particles (7) and cyan magnetophoretic particles (8) and white magnetophoretic particles (2) were replaced by white non-magnetic particles (2'). The respective colors were coated in a stripe form by a printing method and dried to obtain a recording material as shown in FIG. 3. A magnetic field was applied thereto in a stripe form so as to correspond to the respective color stripes and the operation was conducted similarly to Example 1 to obtain a tone pattern comprised of white (minimum reflection density) and black (maximum reflection density). The thus obtained recording material was evaluated similarly to Example 1 and it was proved that the recording material exhibited a reflection density variation of 94% and superior storage stability was achieved. Further, a color image was obtained by separately adjusting the strength of the applied magnetic field for the respective colors.

Example 5

Figure 4:
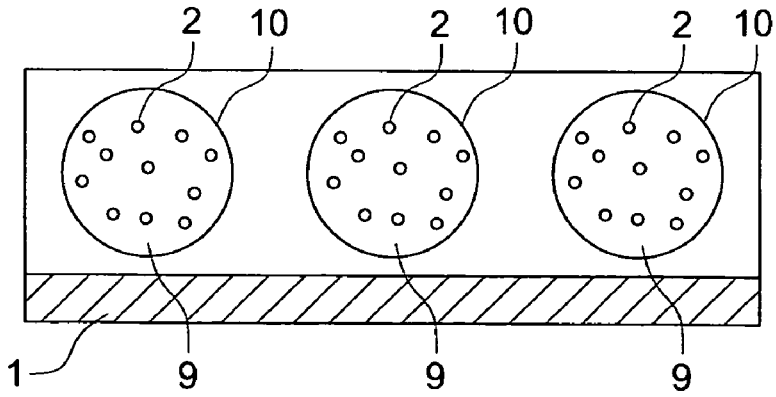
FIGS. 4 to 7 each illustrates a recording material relating to embodiment of the invention.

A paper support laminated with a high density polyethylene on both sides of base paper of 180 g/m$^2$ was prepared, in which a polyethylene melt containing 15% by weight of surface-treated anatase type titanium oxide was laminated on the image forming side to obtain a reflection support. A solution comprising a mixture of 25 parts of pentaerythritol tetraacrylate, 75 parts of pentaerythritol hexaacrylate, 0.2 part of pentaerythritol tetrakis-3-mercaptopropionate, 0.7 part of Irgacure 261 (available from Ciba Speciality Chemicals Co.), 10 parts of styrene-maleic acid copolymer, white magnetophoretical particles (2) of Example 1 and dyes (Aldrich Blue N, Aldrich Sudan Red 7B) was mixed in an amount of 100 parts with 200 parts of an aqueous solution containing 10 parts of poly(styrenesulfonic acid) and dispersed using a homogenizer to obtain an emulsion. To the emulsion, an aqueous solution containing a melamine-formaldehyde resin polymer, having a pH of 9 was added and allowed to react at 55° C. for 4 hrs. with stirring. After adjusted to a pH of 7, the reaction mixture was cooled to obtain a dispersion of microcapsules having a melamine-formaldehyde resin as a wall material. The thus obtained microcapsule dispersion was added with a 10% aqueous polyvinyl alcohol solution (PVA 117, Kuraray) and coated on the foregoing reflection support and dried. Further thereon, Cybinol EK-55 (acryl resin, available from Cyden Chemicals Co.) was coated in an amount of 5 g/m$^2$ and dried to prepare a recording material shown in FIG. 4, in which the numeral 9 designates the foregoing black dye and photopolymerizable composition, and the numeral 10 designates a microcapsule. Image formation and evaluation of Sample 4 was conducted similarly to Example 1 and it was proved that the sample exhibited a reflection density variation of 95% and superior storage stability.

Example 6

Figure 5:
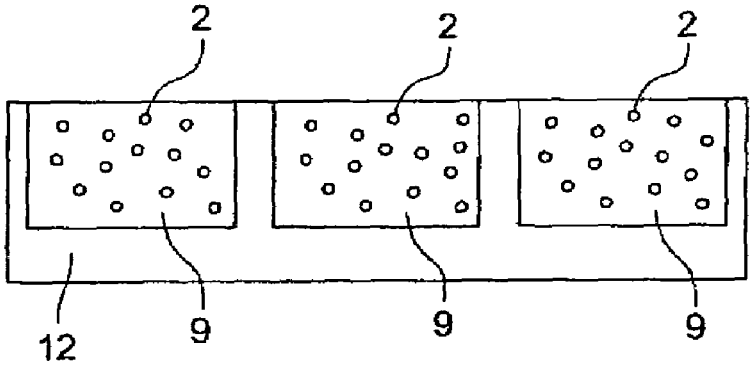

A 200 μm thick white polyethylene terephthalate (white PET) support was perforated by calendaring on a molding roll to form a honeycomb-form pattern on the substrate (recessed support). 100 Parts of a mixture comprising 25 parts of pentaerythritol tetraacrylate, 75 parts of pentaerythritol hexaacrylate, 0.2 part of pentaerythritol tetrakis-3-mercaptopropionate, 0.7 part of Irgacure 261 (available from Ciba Speciality Chemicals Co.), white magnetophoretic particles and dyes (Aldrich Blue N, Aldrich Sudan Red 7B) were mixed in a solution. This solution was sealed into the respective perforations using an ink-jet coating method. Further thereon, Cybinol EK-55 (acryl resin, available from Cyden Chemicals Co.) was coated in an amount of 5 g/m$^2$ and dried to prepare a recording material shown in FIG. 5, in which the numeral 12 designates the foregoing recessed support. Image formation and evaluation of the recording material were conducted similarly to Example 1 and it was proved that the recording material exhibited a reflection density variation of 94% and superior storage stability was achieved.

Example 7

Figure 6:
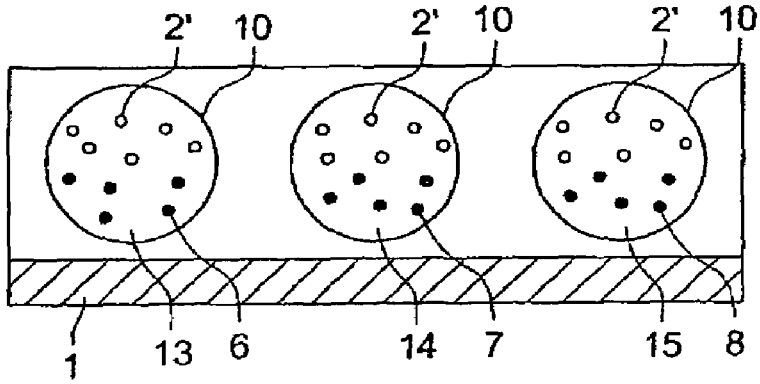

As shown in FIG. 6, a recording material was prepared similarly to the recording material of Example 5, provided that three kinds of microcapsules were prepared by replacing Irgacure 261 by 3,3'-dimethyl-1-heptylindo-3'-heptylthiacyanine-triphenyl-n-butylborate, 1,1'-di-n-heptyl-3,3,3',3"-tetramethylindocarbocyaninetriphenyl-n-butylborate and 1,1'-di-n-heptyl-3,3,3',3"-tetramethylindodicarbocyanine-triphenyl-n-butylborate, respectively, and the prepared microcapsule solutions were mixed. In FIG. 6, the numerals 13, 14 and 15 designate a blue-sensitive photopolymerizable composition, a green-sensitive photopolymerizable composition and a red-sensitive photopolymerizable composition, respectively. Image formation and evaluation of the recording material were conducted similarly to Example 1 and it was proved that the sample exhibited a reflection density variation of 94%. Using three light sources having emission peaks at 450 nm, 550 nm and 650 nm, respectively, the recording material was exposed with adjusting a light source intensity. Applying a magnetic field of a 100 mT flux density from both sides of the recording material resulted in color images corresponding to the foregoing exposures.

Comparative Example 1

Figure 7:
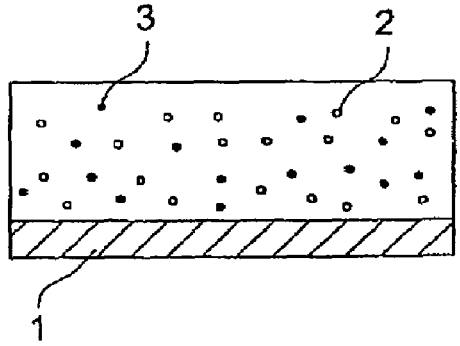

As shown in FIG. 7, a recording material was prepared similarly to Example 1, provided that pentaerythritol tetraacrylate, pentaerythritol hexaacrylate, 0.2 part of pentaerythritol tetrakis-3-mercaptopropionate and Irgacure 261 were excluded. Image formation and evaluation of the recording material were conducted similarly to Example 1 and it was proved that the sample exhibited a reflection density variation of 65%.

What is claimed is:

1. An image forming method comprising:

(a) exposing a recording material comprising on a support an image forming layer containing colored magnetophoretic particles, colored non-magnetic particles differing in color from the colored magnetophoretic particles, and a photopolymerizable composition, to light to perform photocuring and (b) applying a magnetic field to the recording material to migrate the magnetophoretic particles.

2. The image forming method of claim 1, wherein the method comprises:

(i) imagewise exposing the recording material to light to perform photocuring and then (ii) applying a magnetic field to the recording material to migrate the magnetophoretic particles.

3. The image forming method of claim 1, wherein the method comprises:

(i) imagewise applying a magnetic field to the recording material to migrate the magnetophoretic particles and then (ii) exposing the recording material to light to perform photocuring.

4. The image forming method of claim 1, wherein the recording material is exposed to a light having plural emission peaks in the wavelength range of 400 to 700 nm.

5. The image forming method of claim 2, wherein the method further comprises (iii) exposing the recording material overall to the light.

6. The image forming method of claim 1, wherein the magnetophoretic particles comprise white particles or black particles.

7. The image forming method of claim 1, wherein the magnetophoretic particles comprises yellow particles, magenta particles and cyan particles.

8. The image forming method of claim 1, wherein the magnetophoretic particles and the photopolymerizable composition are included in capsules.

9. The image forming method of claim 1, wherein the support has recesses at regular intervals.

10. The image forming method of claim 1, wherein the recording material further comprises a white light-scattering layer.

11. The image forming method of claim 1, wherein the non-magnetic particles are white particles or black particles.

12. The image forming method of claim 11, wherein the non-magnetic particles are white particles.

* * * * *